United States Patent [19]

Morita et al.

[11] Patent Number: 4,644,923

[45] Date of Patent: Feb. 24, 1987

[54] ELECTRONICALLY CONTROLLED FUEL INJECTION APPARATUS FOR INTERNAL COMBUSTION ENGINE

[75] Inventors: Kiyomi Morita; Mineo Kashiwaya; Masahide Sakamoto, all of Katsuta, Japan

[73] Assignee: Hitachi, Ltd., Tokyo, Japan

[21] Appl. No.: 716,638

[22] Filed: Mar. 27, 1985

[30] Foreign Application Priority Data

Mar. 27, 1984 [JP] Japan ..... 59-59133

[51] Int. Cl.[4] ..... F02D 41/12

[52] U.S. Cl. ..... 123/493; 123/325

[58] Field of Search ..... 123/493, 492, 325

[56] References Cited

U.S. PATENT DOCUMENTS 4,359,993 11/1982 Carlson ..... 123/493 X 4,489,696 12/1984 Kobayashi et al. ..... 123/493

4,512,318 4/1985 Ito et al. ..... 123/493 X 4,515,130 5/1985 Hasegawa ..... 123/493

4,520,783 6/1985 Matsushito et al. ..... 123/493 X

*Primary Examiner*—Tony M. Argenbright

*Attorney, Agent, or Firm*—Antonelli, Terry & Wands

[57] ABSTRACT

An electronically controlled fuel injection apparatus in which opening degree of a throttle valve or throttle aperture is sampled periodically at a predetermined time interval to detect change in the throttle aperture for determining deceleration. Upon every determination of the deceleration, a correcting quantity is accumulatively determined so that deceleration is corrected for compensating delay in the control of fuel injection in dependence on magnitude of change in the throttle aperture. An improved engine performance and optimum air-fuel ratio control can be accomplished.

3 Claims, 5 Drawing Figures

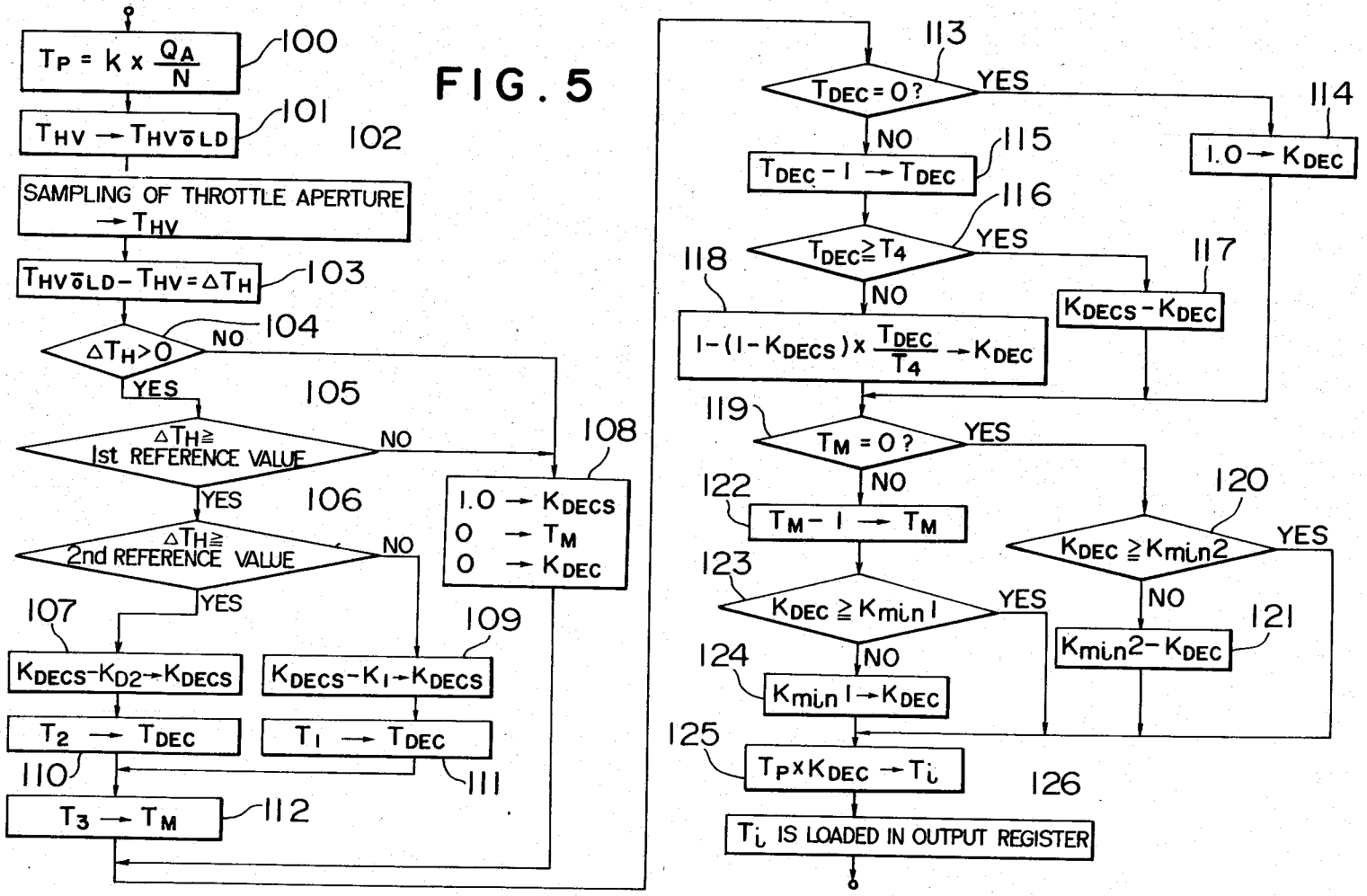
FIG. 5
100
101
102
103
104
105
106
107
108
109
110
111
112
113
114
115
116
117
118
119
120
121
122
123
124
125
126
$T_P = k \times \frac{Q_A}{N}$
$T_{HV} \rightarrow T_{HV\bar{o}LD}$
SAMPLING OF THROTTLE APERTURE $\rightarrow T_{HV}$
$T_{HV\bar{o}LD} - T_{HV} = \Delta T_H$
$\Delta T_H > 0$
YES
NO
$\Delta T_H \geq$ 1st REFERENCE VALUE
$\Delta T_H \geq$ 2nd REFERENCE VALUE
$1.0 \rightarrow K_{DECS}$
$0 \rightarrow T_M$
$0 \rightarrow K_{DEC}$
$K_{DECS} - K_{D2} \rightarrow K_{DECS}$
$T_2 \rightarrow T_{DEC}$
$T_3 \rightarrow T_M$
$K_{DECS} - K_1 \rightarrow K_{DECS}$
$T_1 \rightarrow T_{DEC}$
$T_{DEC} = 0$?
$T_{DEC} - 1 \rightarrow T_{DEC}$
$1.0 \rightarrow K_{DEC}$
$T_{DEC} \geq T_4$
$1 - (1 - K_{DECS}) \times \frac{T_{DEC}}{T_4} \rightarrow K_{DEC}$
$K_{DECS} - K_{DEC}$
$T_M = 0$?
$T_M - 1 \rightarrow T_M$
$K_{DEC} \geq K_{min2}$
$K_{min2} - K_{DEC}$
$K_{DEC} \geq K_{min1}$
$K_{min1} \rightarrow K_{DEC}$
$T_P \times K_{DEC} \rightarrow T_i$
$T_i$ IS LOADED IN OUTPUT REGISTER

ELECTRONICALLY CONTROLLED FUEL INJECTION APPARATUS FOR INTERNAL COMBUSTION ENGINE

BACKGROUND OF THE INVENTION

The present invention generally relates to an electronically controlled fuel injection system for an internal combustion engine. More particularly, the invention is directed to the provision of an electronically controlled fuel injection system which can assure an improved operation performance and optimum air-fuel ratio control by correcting deceleration for compensating delay involved in the air-fuel ratio control based on an air flow sensor in dependence on the opening degree of a throttle valve.

In general, the air flow fed to an internal combustion engine varies in proportion to the opening degree of a throttle valve (also referred to as the throttle aperture). However, in actuality, the air flow can not immediately follow a change in the throttle aperture. For example, when the throttle valve is closed completely starting from the fully opened state, the air flow can vary correspondingly only with a time lag. This can be explained by the fact that the air suction passage extending from the position of the throttle valve has a predetermined length and that the air flow sensor is disposed at a position upstream of the throttle valve. Under the circumstance, the air-fuel ratio control can not be accomplished in a satisfactory manner. More specifically, when a motor vehicle is to be decelerated (through engine braking), the throttle valve is moved in the closing direction, as a result of which the air fuel mixture must become lean. However, in actuality, since the optimum fuel supply injected through the electronically controlled fuel injector is arithmetically determined on the basis of the intake air flow detected by the flow sensor, the air fuel mixture tends to be temporarily enriched, resulting in a condition in which deceleration through engine braking can not take place in a desired manner. To overcome this difficulty, it is known to correct the delay involved in the air/fuel ratio control by opening and/or closing the throttle valve so that the output signal of the air flow sensor can be utilized in the control of the fuel supply without a time lag.

In an electronically controlled fuel injection system disclosed in Japanese Patent Application Laid-Open No. 185949/1983, correction of deceleration is effected by using a so-called throttle sensor. More specifically, when the rate of change or derivative of the output signal exceeds a predetermined value, the amount of fuel supply arithmetically determined on the basis of the amount of intake air detected by the air flow sensor is corrected by multiplying it with a coefficient of a certain value (e.g. 0.9). This correction is referred to as the correction of deceleration while the coefficient is referred to as the deceleration correcting coefficient. The known deceleration correcting system is however disadvantageous in that the correction is made to the same extent for different changes in the throttle aperture. For example, referring to FIG. 1 of the accompanying drawings, when the correction of deceleration is performed by multiplying by the correcting coefficient having a value predetermined for a given rate of change in the throttle aperture or derivative of the throttle sensor output, the same correction will be made for both the cases where the throttle aperture is changed to a level A shown in FIG. 1 and where the throttle aperture is decreased to a lower level B, notwithstanding the fact that a change in the air flow in the first mentioned case differs from the second case, thus making it impossible to realize the optimim airflow ratio control.

SUMMARY OF THE INVENTION

An object of the present invention is to provide an electrically controlled fuel injection apparatus for an internal combustion engine which is capable of realizing the optimum air-fuel ratio control by correcting or compensating the delay involved in the control described above.

In view of the above and other objects which will be apparent as description proceeds, it is proposed according to an aspect of the present invention that the throttle aperture is periodically sampled at a predetermined time interval to determine the rate of change or derivative of the throttle aperture for detecting deceleration, wherein upon every detection of the deceleration, the correcting value is accumulated or integrated, to allow a large magnitude of the change in the throttle aperture to be discriminated from a small change thereof for realizing the optimum correction of deceleration and hence the optimum air-fuel ratio control.

BRIEF DESCRIPTION OF THE DRAWINGS

The above and other objects, features and advantages of the present invention will be more clear from the following description with reference to the accompanying drawings, in which:

FIG. 5 shows a flow chart for illustrating an air-fuel control according to an embodiment of the invention.

DESCRIPTION OF THE PREFERRED EMBODIMENTS

Figure 1:
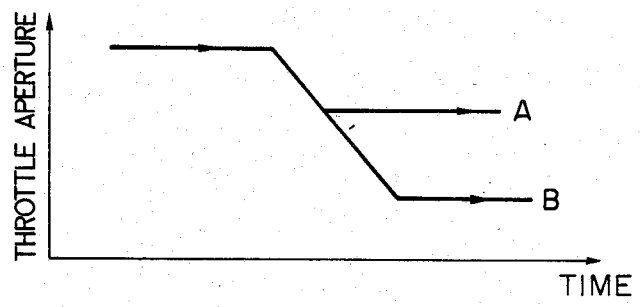
FIG. 1 PRIOR ART
FIG. 1 is a view for illustrating the hitherto known air-fuel ratio control by detecting the rate of change in the throttle aperture (opening of a throttle valve)

Now, the invention will be described in conjunction with an exemplary embodiment thereof by referring to the drawings.

Figure 2:
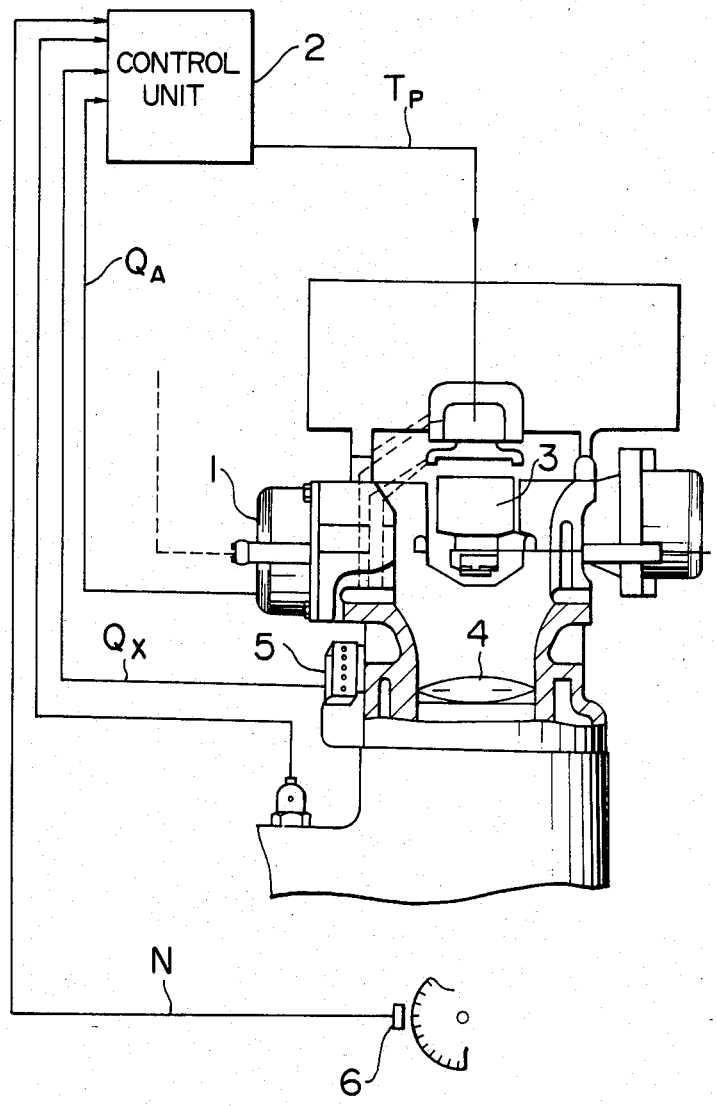
FIG. 2 is a schematic side view of an internal combustion engine equipped with various sensors to which the invention can be applied.

FIG. 2 shows an internal combustion engine to which the present invention can be applied.

Figure 3:
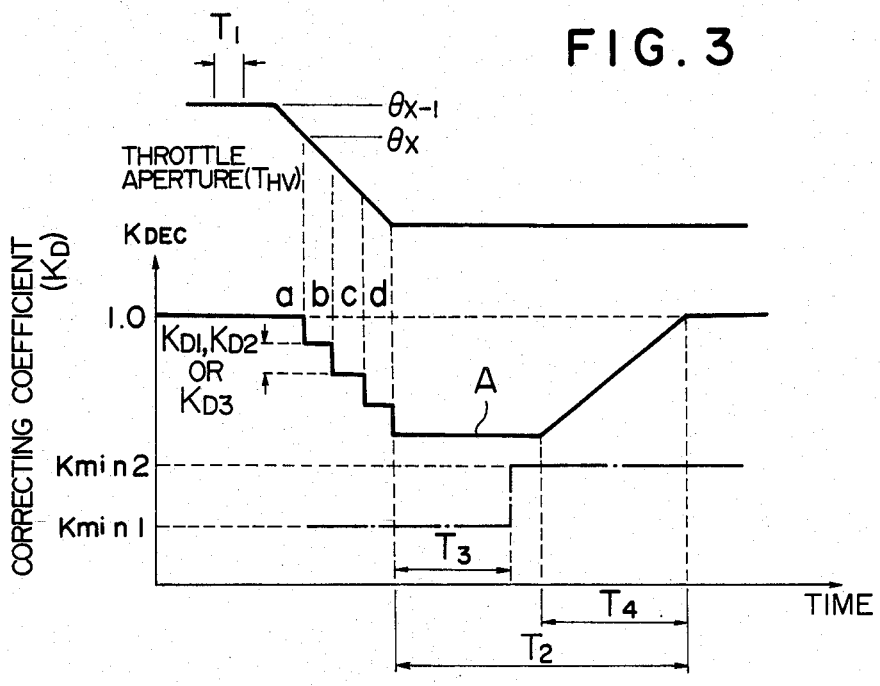
FIG. 3 is a view for illustrating operation of an electronically controlled fuel injection apparatus.

Referring to the figure, the air sucked into an internal combustion engine is measured by an air flow sensor 1. The value of the air flow as detected by the sensor 1 is supplied to a control unit 2 which is so arranged as to arithmetically determine the amount of fuel to be supplied to the engine on the basis of engine revolution number N which is determined by counting pulses generated by a crank angle sensor 6, whereby a number of pulses corresponding to the determined amount of fuel are outputted to a fuel injector 3, resulting in the amount of fuel corresponding to the input pulse number being ejected. Now, representing the suction or intake air flow by $Q_A$ and the revolution number of the engine by N, the pulse width $T_p$ of the basic pulse supplied to the injector 3 is given by the following expression $$T_p = k \times Q_A / N \quad (1)$$

where k represents a constant. On the other hand, an output signal of a throttle sensor 5 which is representative of the aperture (i.e. opening degree) of a throttle valve 4 is sampled and fetched periodically at a time interval $T_1$ (e.g. every 10 msec), as is illustrated in FIG. 3, to examine the rate of change (or derivative) $\Delta\theta$ in the throttle aperture. When the aperture (or opening degree) of the throttle valve 4 sampled at the last time point is represented by $\theta_x$ while the throttle aperture sampled at a time point preceding to the last sampling point by the time interval $T_1$ msec is represented by $\theta_{x-1}$, it is decided that deceleration (i.e. reduction in speed) occurs when the condition given by $\theta_{x-1}-\theta_x \geqq \Delta\theta_1$ (where $\Delta\theta_1$ represents a first rate of change in the throttle aperture) is met, and a corresponding deceleration correcting coefficient $k_{D1}$ is set.

On the other hand, in case $\theta_{x-1}-\theta_x \geqq \Delta\theta_2$ where $\Delta\theta_2$ represents a second rate of change in the throttle aperture, a corresponding deceleration correcting coefficient $k_{D2}$ is set in accordance with the decision to the effect that greater deceleration occurs than in the case of $\Delta\theta_1$. Further, in case $\theta_{x-1}-\theta_x \geqq \Delta\theta_3$ where $\Delta\theta_3$ represents a third rate of change in the throttle aperture, it is decided that corresponding deceleration is greater than in the case of $\Delta\theta_2$, to thereby set a deceleration correcting coefficient $k_{D3}$. In this connection, correspondences between $\Delta\theta_1$, $\Delta\theta_2$ and $\Delta\theta_3$ and $k_{D1}$, $k_{D2}$ and $k_{D3}$, respectively, may be, for example, set as follows:

$\Delta\theta_1 = 1°/10$ m sec . . . $k_{D1}$ of 0.95 (5%)

$\Delta\theta_2 = 2°/10$ m sec . . . $k_{D2}$ of 0.9 (10%)

$\Delta\theta_3 = 3°/10$ m sec . . . $k_{D3}$ of 0.85 (15%)

The deceleration correcting coefficients $k_D$ are employed for correcting the width of the injection pulse in accordance with the following expression:

$$T_i = T_p \times k_D \quad (2)$$

where $T_i$ represents the width of the injection pulse, $T_p$ represents the width of the basic pulse, and $k_D$ represents deceleration correcting coefficient.

Figure 4:
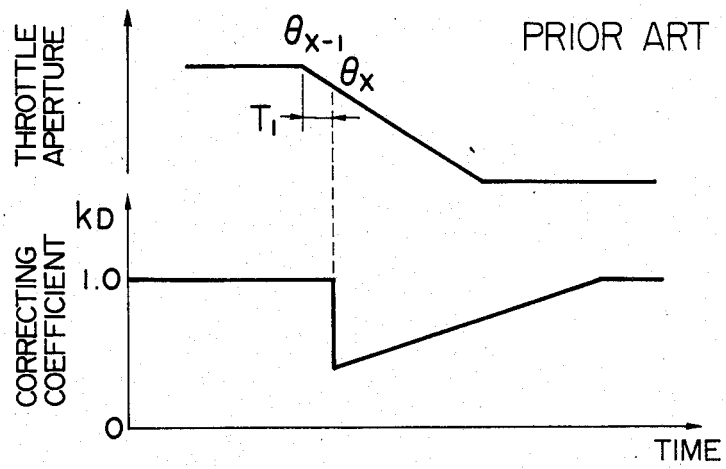
FIG. 4 PRIOR ART
FIG. 4 is a view for graphically illustrating a curve of deceleration correcting coefficient.

In the hitherto known deceleration correcting method, the deceleration correcting coefficient $k_D$ varies as a function of time elapse following the detection of deceleration and is ultimately restored to $k_D = 1.0$, as is illustrated in FIG. 4. In connection with the hitherto known control system, it is however noted that the same correction is performed for both decelerations to the levels A and B (see FIG. 1), which means that a correcting coefficient suited for the deceleration or slowdown to the level A is inadequate for the deceleration to the level B, resulting in the quality of the discharged gas being degraded. On the other hand, the correcting coefficient determined for the deceleration to the level B involves correction in excess of that for the deceleration to the level A, giving rise to occurrence of discomfortable shocks.

In contrast, in the case of the illustrated embodiment of the present invention, when the rate of change $\Delta\theta_1$ in the throttle aperture is detected at a time point a shown in FIG. 3, the deceleration correcting coefficient $k_{D1}$ is selected and value of correction is arithmetically determined as follows:

$$T_i = T_p \times k_{D1} = 0.95\ T_p$$

When the rate of change $\Delta\theta_3$ in the throttle aperture is detected at a succeeding sampling time point b shown in FIG. 3, the deceleration correcting coefficient $k_{D3}$ is selected, whereby the value of correction is arithmetically determined with the preceding correction being added. That is, $$T_i = T_p \times [0.95-(1-K_{D3})] = 0.8\ T_p$$

Further, when rate of change $\Delta\theta_2$ in the throttle aperture is detected at a further succeeding sampling time point, e.g. at the time point c shown in FIG. 3, the deceleration correcting coefficient $k_{D2}$ is selected to determine the value of correction with the preceding correction being added, as follows:

$$T_i = T_p \times [0.8-(1-k_{D2})] = 0.7\ T_p$$

Additionally, upon detection of change $\Delta\theta_1$ in the throttle aperture at a further succeeding sampling point, e.g. at the time point d shown in FIG. 3, the deceleration correction coefficient $k_{D1}$ is selected to determine the value of correction with the preceding correction being added, as follows:

$$T_i = T_p \times [0.7-(1-k_{D1})] = 0.65\ T_p$$

In this way, correction for deceleration can be repeatedly effected every time the rates of change in the throttle aperture are detected by integrating the deceleration correcting coefficients selected at each interval during deceleration, so long as the throttle aperture remains above a first lower limit $K_{min\ 1}$ (e.g. 0.4) shown in FIG. 3. When the first limit level $K_{min\ 1}$ has been attained, this level $K_{min\ 1}$ is automatically changed over to a second limit level $K_{min\ 2}$ (e.g. 0.6) after lapse of a certain time $T_3$ (e.g. 50 m sec) following the last correction of deceleration (e.g. at a time point d in FIG. 3). From the second limit level $K_{min\ 2}$, the deceleration correcting coefficient $k_D$ is restored to the value 1 with a slope determined in dependence on the time lapse $T_2$ (e.g. 200 m sec–400 m sec) from the last detection of deceleration. In other words, during this restoring period, no correction for deceleration is performed, wherein the amount of fuel supply is determined in dependence on the air flow as detected.

Accordingly, in the case of correction for deceleration at the level A shown in FIG. 3, the deceleration correcting coefficient $k_D$ approaches or rises up to 1.0 linearly from a time point ($T_1$–$T_4$) or ($T_2$–$T_4$) during a period $T_4$.

In this manner, the number of corrections is increased as the period during which deceleration takes place is longer, while the quantity or magnitude of correction is increased as the rate at which the throttle valve is closed for deceleration is higher. In other words, correction of deceleration is controlled finely in dependence on magnitude of deceleration.

FIG. 5 is a flow chart for illustrating the control procedure on the assumption that two deceleration correcting coefficients ($\Delta\theta_1$ and $\Delta\theta_2$) are employed. Referring to FIG. 5, the basic pulse width $T_p$ is determined at a step 100 from the amount of air suction $Q_A$ and the engine revolution number N in accordance with $T_p = k \times (Q_A/N)$. At a succeeding step 101, the throttle aperture (i.e. opening degree of the throttle valve) $T_{HV}$ is set at the preceding throttle aperture $T_{EVOLD}$ which is then stored in a memory. At a step 102, the current throttle aperture $T_{EV}$ is sampled and stored in a memory area reserved for storing the current throttle aperture. Next, at a step 103, the change $\Delta T_H$ in the throttle aperture is determined in accordance with $T_{HVOLD}-T_{HV}=\Delta T_H$. It is then checked at a step 104 whether or not the change $\Delta T_H$ is greater than 0 (zero). When it is decided that the change $\Delta T_H$ in the throttle aperture is greater than 0 (zero), it is then checked if the change $\Delta T_H$ is greater than or equal to a first reference value $\Delta\theta_1$. When the result of the decision step 105 is affirmative (YES), it is again checked at a step 106 if the change $\Delta T_H$ is greater than or equal to a second reference value $\Delta\theta_2$. In case the decision of the step 106 results in "YES", the correcting coefficient $k_{D2}$ is determined. On the other hand, when the decision step 106 results in that $\Delta T_E$ is smaller than $\Delta\theta_2$, the correcting coefficient $k_{D1}$ is determined at a step 109. Further, when it is decided at the step 104 that $\Delta T_H<0$ (zero) and when it is decided at the step 105 that $\Delta T_H<\Delta\theta_1$, then the correcting coefficient $k_D$ is set to 1 (one) at a step 108, while the sampling timer $T_M$ is set to zero (reset) with the deceleration time also being set to zero.

Following the determination of the deceleration correcting coefficient $k_{D2}$ at the step 107, the deceleration time $T_{DEC}$ is set to $T_2$ at a step 110. On the other hand, when the correcting coefficient $k_{D1}$ is determined at the step 109, the deceleration time $T_{DEC}$ is set to $T_1$. Subsequently, time $T_3$ is set at the timer $T_M$ at a step 112. Next, at a step 113, it is decided whether the deceleration time is 0 (zero) or not. If zero, the deceleration correcting coefficient $K_{DEC}$ ($k_D$) is set to 1 (one). When the decision step 113 results in "NO", the deceleration time $T_{DEC}$ is set as it is at a step 115, which is followed by a step 116 where it is decided whether the set deceleration time $T_{DEC}$ is greater than or equal to a time $T_4$. In case $T_{DEC}\geqq T_4$, the deceleration correcting coefficient $K_{DECS}$ set at the step 107 is set as the deceleration correcting coefficient $K_{DEC}$ at a step 117. On the other hand, in case decision at the step 116 results in $T_{DEC}<T_4$, the deceleration correcting coefficient $K_{DEC}$ is determined at a step 118, which is followed by a step 119 where a decision is made as to whether the timer is 0 (zero). When the decision step 119 indicates that the timer is 0 (zero), it is then decided at a step 120 whether the deceleration correcting coefficient $K_{DEC}$ is greater than or equal to the second limit value $K_{min\,2}$. If so, then the procedure proceeds to a step 125. On the other hand, when it is decided at a step 120 that $K_{DEC}<K_{min\,2}$, the second limit value $K_{min\,2}$ is set as the deceleration correcting coefficient. Further, when the decision step 119 indicates that the timer $T_M$ is not zero, the timer is set at a step 122, which is followed by the step 123 where decision is made as to whether the deceleration correcting coefficient $K_{DEC}$ is greater than the first limit value $K_{min\,1}$, inclusive thereof. When $K_{DEC}\geqq K_{min\,1}$, the step 125 is then executed. Otherwise, the first limit value is set as the deceleration correcting coefficient. At the step 125, the basic pulse width $T_p$ is multiplied by the deceleration correcting coefficient $K_{DEC}$ to produce the injection pulse width $T_i$. At a final step 126, the injection pulse width $T_i$ is loaded in an output register.

As will be appreciated from the foregoing description, optimum control of air-fuel ratio can be accomplished according to the teaching of the invention.

What is claimed is:

1. An electronically controlled fuel injection apparatus, including a crank angle sensor for detecting the revolution number of an internal combustion engine and an air flow sensor for detecting the amount of air sucked by an engine cylinder, fuel being supplied to said engine in the amount determined in dependence on output signals produced by both of said sensors, respectively, further comprising a throttle sensor for detecting throttle aperture, first means for sampling at a predetermined periodic interval the signal produced by said throttle sensor and representing the throttle aperture, second means for comparing the signals sampled at every interval by said first means to detect the rate of change of the throttle aperture, selecting means for selecting a deceleration correcting coefficient at each sampling interval based on the rate of change of the throttle aperture, integrating means for integrating the deceleration correcting coefficients selected at each interval during deceleration and third means for performing correction of deceleration with the aid of said integrated deceleration correcting coefficients when the value resulting from said comparison is not smaller than a predetermined value.

2. An electronically controlled fuel injection apparatus according to claim 1, wherein a deceleration limit value is provided for the correction of deceleration effected by said third means.

3. An electronically controlled fuel injection apparatus according to claim 1, wherein said integrating means operates to produce an integrated deceleration correcting coefficient $K_{Di}$ having the relationship $$K_{Di}=K_{Dt1}-(1-K_{Dt2})$$

where $K_{Dt1}$ and $K_{Dt2}$ are deceleration correcting coefficients selected during successive sampling intervals $t_1$ and $t_2$ during deceleration.

* * * * *